US009045265B2

(12) United States Patent
Adamczak

(10) Patent No.: US 9,045,265 B2
(45) Date of Patent: Jun. 2, 2015

(54) CHILD PROOF CLOSURE CAP FOR CONTAINER WITH COMBINED TILTING AND ROTATING OPERATION

(71) Applicant: Gregory Mark Adamczak, Stamford, CT (US)

(72) Inventor: Gregory Mark Adamczak, Stamford, CT (US)

(73) Assignee: Gregory Mark Adamczak, Stamford, CT (US)

( * ) Notice: Subject to any disclaimer, the term of this patent is extended or adjusted under 35 U.S.C. 154(b) by 27 days.

(21) Appl. No.: 13/632,824

(22) Filed: Oct. 1, 2012

(65) Prior Publication Data

US 2013/0026126 A1 Jan. 31, 2013

Related U.S. Application Data

(63) Continuation-in-part of application No. 12/806,108, filed on Aug. 5, 2010, now Pat. No. 8,286,811.

(51) Int. Cl.
*B65D 50/04* (2006.01)

(52) U.S. Cl.
CPC ..... *B65D 50/041* (2013.01)

(58) Field of Classification Search
CPC ..... B65D 50/041; B65D 50/04; B65D 50/02; B65D 50/00; B65D 2215/02; B65D 2213/00
USPC ..... 215/216–221, 224, 225
See application file for complete search history.

(56) References Cited

U.S. PATENT DOCUMENTS

| | | | | | |
|---|---|---|---|---|---|
| 3,055,524 | A | * | 9/1962 | Glasbrenner | 215/220 |
| 3,394,829 | A | * | 7/1968 | Peterson | 215/220 |
| 3,722,727 | A | * | 3/1973 | Gach | 215/220 |
| 3,756,444 | A | * | 9/1973 | McIntosh | 215/220 |
| 3,776,407 | A | * | 12/1973 | Cistone | 215/220 |
| 3,792,793 | A | | 2/1974 | Rose | |
| 3,797,688 | A | * | 3/1974 | Porcelli et al. | 215/220 |
| 3,863,796 | A | * | 2/1975 | Roy | 215/220 |
| 3,888,375 | A | * | 6/1975 | Gerk | 215/219 |
| 3,926,326 | A | * | 12/1975 | Grau | 215/218 |
| 3,944,102 | A | | 3/1976 | Grau | |
| 4,157,142 | A | | 6/1979 | Kong | |
| 4,319,690 | A | * | 3/1982 | Birrell et al. | 215/220 |
| 4,360,113 | A | | 11/1982 | Luker | |
| 4,365,721 | A | | 12/1982 | Montgomery | |
| 4,385,705 | A | * | 5/1983 | Kusz | 215/220 |
| 4,576,298 | A | | 3/1986 | Boik | |
| 4,598,833 | A | * | 7/1986 | Herr | 215/220 |
| 4,609,114 | A | | 9/1986 | Roy | |
| 4,632,264 | A | * | 12/1986 | Evans | 215/220 |
| 4,673,095 | A | * | 6/1987 | Puresevic et al. | 215/220 |
| 4,801,028 | A | * | 1/1989 | Puresevic et al. | 215/220 |
| 4,991,729 | A | | 2/1991 | Hunter | |
| 4,997,096 | A | | 3/1991 | Kusz | |
| 5,280,842 | A | * | 1/1994 | Koo | 215/220 |

(Continued)

*Primary Examiner* — Anthony Stashick
*Assistant Examiner* — Ernesto Grano
(74) *Attorney, Agent, or Firm* — St. Onge Steward Johnston & Reens LLC

(57) ABSTRACT

A child-proof closure cap for containers having an inner cap and an outer cap assembled for tilting with respect to each other. The inner cap includes an outer surface with notches for engagement with internal teeth on an inner surface of the outer cap to facilitate removal of the closure cap from the container with either left hand or right hand operation according to user's natural ability. The outer cap has a spring that is adapted to spring load the outer cap in a non-tilt arrangement relative to the inner cap.

20 Claims, 10 Drawing Sheets

(56) References Cited

U.S. PATENT DOCUMENTS

| | | | | |
|---|---|---|---|---|
| 5,411,157 | A | 5/1995 | King et al. | |
| 5,611,443 | A | 3/1997 | King | |
| 5,743,419 | A * | 4/1998 | King | 215/217 |
| 5,762,215 | A * | 6/1998 | Ogden | 215/220 |
| 6,085,920 | A | 7/2000 | Moretti | |
| 6,206,216 | B1 | 3/2001 | Stalions | |
| 6,609,637 | B1 | 8/2003 | Suffa | |
| 7,100,785 | B1 | 9/2006 | Suffa | |
| 7,111,746 | B2 * | 9/2006 | Miceli et al. | 215/219 |
| 7,401,707 | B2 | 7/2008 | Brozell et al. | |
| 7,571,825 | B2 | 8/2009 | Takahashi | |
| 8,056,742 | B2 | 11/2011 | Brozell et al. | |
| 8,534,476 | B2 * | 9/2013 | Brozell | 215/220 |
| 2004/0182814 | A1 | 9/2004 | Suffa | |
| 2004/0262251 | A1 * | 12/2004 | Tauber | 215/220 |
| 2006/0219651 | A1 | 10/2006 | Takahashi | |
| 2008/0314900 | A1 * | 12/2008 | Biesecker et al. | 220/212 |
| 2009/0032486 | A1 * | 2/2009 | Brozell et al. | 215/220 |
| 2011/0139742 | A1 * | 6/2011 | Brozell | 215/220 |

* cited by examiner

CHILD PROOF CLOSURE CAP FOR CONTAINER WITH COMBINED TILTING AND ROTATING OPERATION

FIELD OF THE INVENTION

The invention relates to closure caps for containers including bottles and jars, and particularly to a child proof closure cap easily removed by right hand or left hand operation.

BACKGROUND OF THE INVENTION

Child proof closure caps are ordinarily used on containers for tablets and liquid preparations sold by prescription or over-the-counter as a precaution against children gaining access to and consuming such preparations. All too often, child proof closure caps present a significant impediment for adults in opening the containers especially adults lacking the necessary level of hand and finger strength or cognitive ability to cope with the cap design.

Closure caps in attaining child proof utility are often complicated in design and construction, thereby adding undesired manufacturing costs to an overall package. Moreover, the design and construction is normally intended for use in a right-handed world, thereby presenting a further significant impediment to those who are left-handed.

There is a need then for a closure cap that combines a child proof design and low manufacturing cost, and that is equally suited for right and left hand removal from a container.

SUMMARY OF THE INVENTION

The present invention is directed to a closure cap suited for child proof applications in packaging tablets and liquids for medicinal or other restricted use, and suited for ease of right and left hand removal of the cap from a container.

One embodiment of the closure cap according to the present invention comprises an inner cap for connection to and for sealing the open end of a container. The inner cap comprises a top panel and depending skirt for covering and sealing a container at its threaded neck. The skirt inner surface is threaded for screwing the closure cap onto the corresponding threads of the container neck. The skirt outer surface has a partially spherical or curved profile (e.g., a spherical section) extending entirely about the skirt for engagement with an outer cap for a purpose detailed below. The skirt outer surface at the juncture with the top panel contains two sets of notches with each set occupying approximately one-half the perimeter of the skirt and top panel, with one set of notches being canted to the right and the other set canted to the left. The notches cooperate with drive teeth depending from inside an outer cap for removing the inner cap from the container.

An outer cap according to the invention comprises a top panel and a skirt depending from the perimeter of the panel. The outer cap skirt has a partially spherical or curved inner surface (e.g., a spherical section) of the same curvature as the outer surface of the inner cap skirt. The outer cap then is snapped in place over the inner cap and by reason of the partially spherical or curved surface interface of outer cap skirt with inner cap skirt, the outer cap to a specified degree tilts in every direction with respect to the inner cap. At the inside of the outer cap at the junction of top panel and depending skirt, the outer cap is fitted with a plurality of drive teeth for insertion into the inner cap notches for twisting the inner cap off the container neck.

The drive teeth are preferably set at diametrically opposed positions on the underside of the outer cap, and engage inner cap notches by tilting the outer cap with respect to the inner cap. A user selects direction of tilt by using either right hand or left hand according to native ability, and twists outer cap either to right or to left in removing inner cap to open the container.

Another embodiment of the closure cap according to the present invention comprises an inner cap having a first top panel and a first skirt extending downward from the first top panel, the first skirt having an outer surface and a plurality of notches with upwardly directed openings around a circumference of the outer surface, wherein an inner surface of the first skirt includes threads for engaging corresponding threads on the container. The closure cap further comprises an outer cap over the inner cap, the outer cap having a second top panel and a second skirt extending downward from the second top panel, the second skirt having an inner surface in engagement with the outer surface of the first skirt, the inner surface of the second skirt including a plurality of teeth projecting inward from the inner surface. By tilting the outer cap, at least a portion of the teeth on the inner surface of the second skirt engage at least a portion of the notches on the outer surface of the first skirt for turning the inner cap on the container. The outer cap further includes a spring disposed on an underside of the second top panel, the spring being adapted to spring load the outer cap in a non-tilt arrangement relative to the inner cap.

The spring may comprise a socket, wherein the socket is engaged with at least a central portion of the first top panel of the inner cap. With the socket disposed over the central portion of the first top panel, the socket provides support for the outer cap and further facilitates pivoting of the outer cap relative to the inner cap during the tilting process. The spring may also have several spring arms mounted to the socket and/or proximate to a center of the underside of the second top panel, wherein the arms extend radially from the socket/center towards the first top panel. With the spring arms contacting the first top panel, at least one of the spring arms is deflected by the first top panel when the outer cap is tilted. When the tilting force is no longer applied to the outer cap, the at least one of the spring arms resists the deflection, returns to its natural state, and thus positions the outer cap in the non-tilt arrangement.

An additional embodiment of the closure cap according to the present invention comprises an inner cap, an outer cap disposed over the inner cap, and a tamper ring secured around the container and frangibly attached to a bottom end of the inner cap, wherein the tamper ring is adapted to indicate whether the container has been tampered with. The inner cap has a first top panel and a first skirt extending downward from the first top panel the first skirt having an outer surface and a plurality of notches with upwardly directed openings around a circumference of the outer surface. The outer cap has a second top panel and a second skirt extending downward from the second top panel, wherein the second skirt has an inner surface in engagement with the outer surface of the first skirt and wherein the inner surface of the second skirt includes a plurality of teeth projecting inward from the inner surface. By tilting the outer cap, the teeth on the inner surface of the second skirt engage the notches on the outer surface of the first skirt for turning the inner cap on the container. The tamper ring ensures that the outer and inner caps do not inadvertently separate from (e.g., is locked to) the container. In some embodiments, the tamper ring is frangibly attached to the end of the first skirt of the inner cap by at least one fastener. In other embodiments, multiple fasteners are distributed around the circumference of the first skirt, each fastener frangibly connecting the end of the first skirt to the tamper ring.

Furthermore, the fasteners are spaced equally from each other around the circumference of the first skirt.

The closure cap according to the present invention may also have a flange positioned at an end of the second skirt of the outer cap along a circumference of the second skirt, such that the flange projects inward from the inner surface of the second skirt and contacts the outer surface of the first skirt. The outer surface of the first skirt of the inner cap may also have a lip that is positioned under the plurality of notches and extends around the first skirt. With this configuration of the closure cap, a first portion of the flange engages the lip and a second portion of the flange engages the tamper ring when the outer cap is tilted. The engagement between the first portion and the lip maintains constant contact between the inner surface of the second skirt and the outer surface of the first skirt. This engagement further reduces the likelihood that the outer cap detaches from the inner cap. With respect to the second portion and the tamper ring, the engagement therebetween provides the means to break the fasteners between the tamper ring and the first skirt upon tilting and rotating the outer cap. As a result, the engagement between the second portion and the tamper ring provides for releasing the tamper ring from the first skirt.

Another embodiment of the closure cap comprises an inner cap having a first top panel and a first skirt extending downward from the first top panel, the first skirt having an outer surface and a plurality of notches with upwardly directed openings around a circumference of the outer surface, wherein an inner surface of the first skirt includes threads for engaging corresponding threads on the container, and an outer cap over the inner cap, wherein the outer cap has a second top panel and a second skirt extending downward from the second top panel, the inner surface of the second skirt including a plurality of teeth disposed proximate to the second top panel and projecting inward from the inner surface, and wherein the outer cap has a flange disposed at an end of the second skirt and extending along a circumference of the second skirt. The flange projects inward from the inner surface of the second skirt and engages the outer surface of the first skirt. The closure cap further includes a plurality of fingers that are positioned around the circumference of the outer surface of the first skirt and extend substantially downward from the outer surface, the fingers being adapted to engage a protrusion on the container. The engagement between the fingers and the protrusion prevents the closure cap from being removed from the container unless the outer cap is tilted and twisted simultaneously. In other words, the outer and inner caps are locked to the container, which reduces the likelihood that the caps and the container inadvertently separate.

In addition, the outer surface of the first skirt may have a lip that is positioned under the notches and extends around the first skirt. When the outer cap is tilted, a first portion of the flange engages the lip and a second portion of the flange deflects at least one of said fingers such that the at least one of said fingers is disengaged from the protrusion on the container. The engagement between the first portion and the lip maintains contact between the inner surface of the second skirt and the outer surface of the first skirt and reduces the likelihood that the outer cap detaches from the inner cap. The deflection of the at least one of said fingers provides for the closure cap to be separated from the container once the outer cap is twisted. In other words, the deflection of the at least one of said fingers unlocks the inner cap and outer cap from the container so that upon rotating the outer cap, both caps can be released from the container.

For the embodiments of the closure cap configured with the tamper ring or fingers engaged with a protrusion on the container, the closure cap may further comprise a spring, the spring being adapted to spring load the outer cap in a non-tilt arrangement relative to the inner cap. The spring may have elastic spring arms mounted proximate to a center of an underside of the second top panel of the outer cap, wherein the spring arms extend radially from the center towards the first top panel of the inner cap, contacting said first top panel.

In view of the above, it is to be understood then, a child proof right and left hand operable closure cap according to the present invention comprises two operating components readily fabricated using commonly available plastic or equivalent material in well known manufacturing processes including plastics molding and metal stamping.

Specific examples are included in the following description for purposes of clarity, but various details can be changed within the scope of the present invention.

An object of the present invention is to provide a new and useful child proof closure cap.

Another object of the present invention is to provide a two-piece closure cap of inner and outer cap members adapted for right hand and left hand use.

Another object of the present invention is to provide a two piece closure cap of inner and outer cap members where the outer cap tilts with respect to the inner cap to facilitate operation of closure with equal ease using right hand or left hand according to user's preference.

A further object of the present invention is to provide a child proof two piece closure cap in which an outer cap tilts in every direction with respect to an inner cap whereupon drive teeth on the outer cap engage receptor notches on the inner cap for removal of inner cap when a user with right hand or left hand selects specific direction of tilt of outer cap for twisting off the inner cap.

An additional object of the present invention is to provide a two-piece closure cap of inner and outer cap members in which the outer cap member is adapted to be disposed in a non-tilt arrangement relative to the inner cap member unless a tilting force is applied to the outer cap member.

Other objects of the present invention is to provide a two-piece closure cap of inner and outer cap members adapted to indicate whether the closure cap has been tampered with.

Other objects of the present invention is to provide a two-piece closure cap of inner and outer cap members in which both cap members facilitate closure of the container and thus reduce the likelihood that the cap members will inadvertently separate from the container without tilting and twisting the outer cap.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
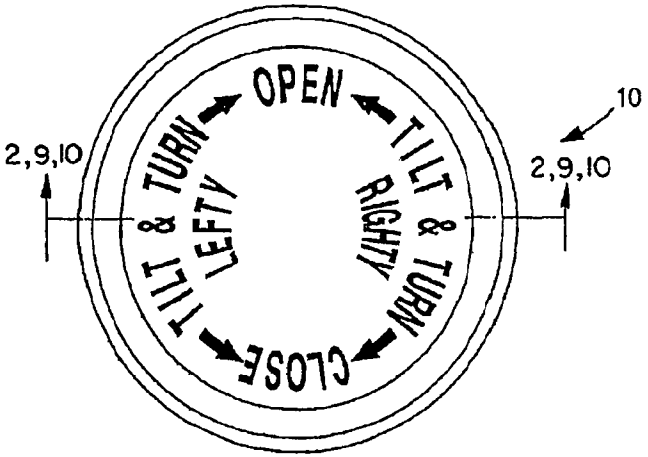
FIG. 1 is a top view of an embodiment of a closure cap according to the invention showing top panel legends for right and left hand turns to open and close cap on a container.

Referring now to the drawings, an embodiment of the present invention comprises a closure cap 10 suited for child proof applications in packaging medicines and other substances intended for restricted use and to be kept out of the reach of children. The closure cap is designed for right and left hand removal of the cap from a container.

Figure 2:
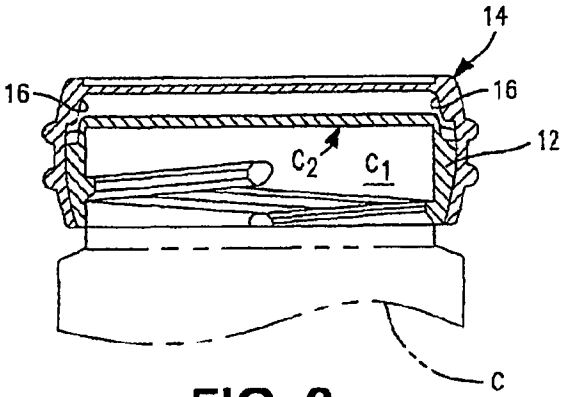
FIG. 2 is a side elevation section view of outer and inner caps in position on a container neck.
Figure 9:
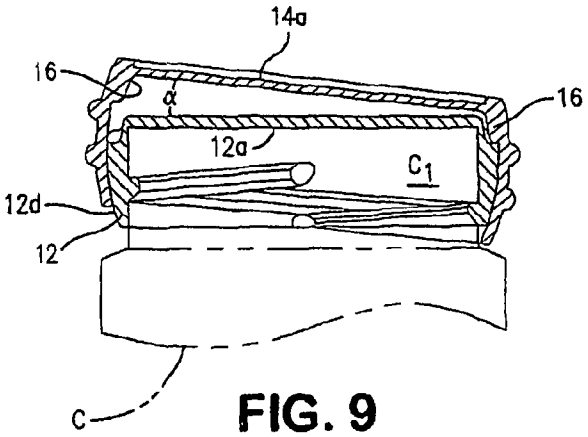
FIG. 9 is a side elevation section view of outer and inner caps tilted into position for right hand removal from a container neck.
Figure 10:
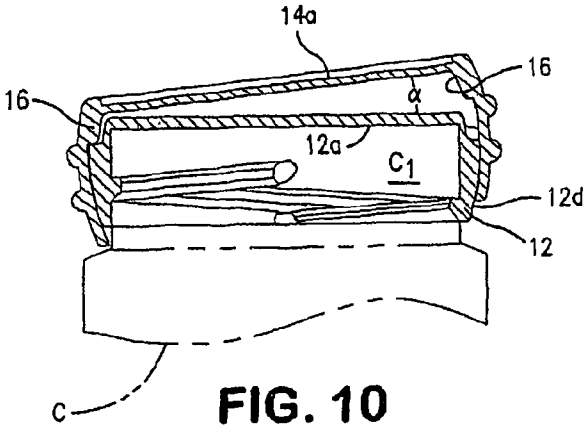
FIG. 10 is a side elevation section view of outer and inner caps tilted into position for left hand removal from a container neck.

A container C shown in dash lines in FIGS. 2, 9, and 10 includes a conventional container in the form of a bottle or jar having a body and means for receiving and securing a closure cap to the container, such as threaded neck C1. The top circular edge or rim C2 of the neck defines a sealing surface engaged and sealed by a corresponding surface of the closure cap or by a sealing liner or gasket forming part of the closure cap. The container opening defined by the neck rim may be covered and sealed by a tamperproof disc in a well-known manner.

Figure 3:
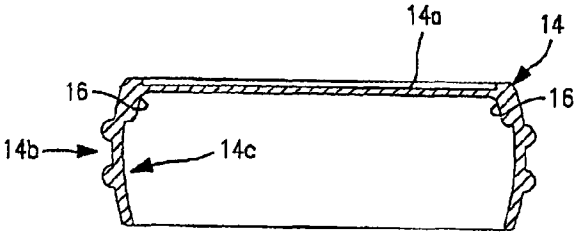
FIG. 3 is a side elevation section view of outer cap of FIG. 2.
Figure 4:
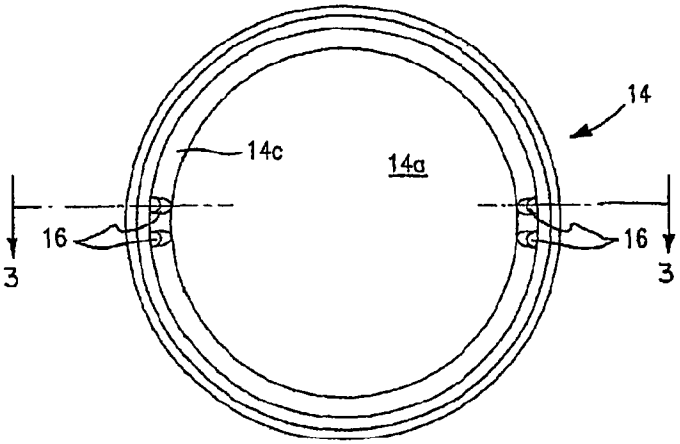
FIG. 4 is a bottom view of outer cap of FIG. 2.
Figure 7:
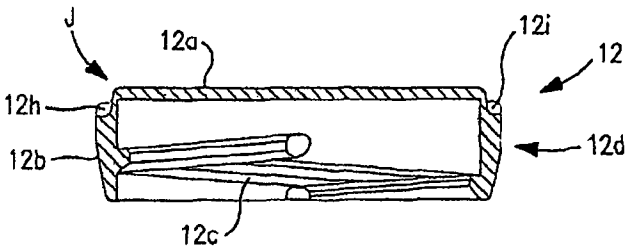
FIG. 7 is a side elevation section view of inner cap of FIG. 2.

A closure cap according to the invention comprises an inner cap 12 for connection to the neck for sealing the open end of the container. The inner cap comprises top panel 12*a* and depending skirt 12*b* for covering and sealing the container at its threaded neck. The skirt inner surface has helical bead 12*c* (FIG. 7) for screwing the closure onto the corresponding threads of the container neck. The outer surface 12*d* of the skirt of inner cap 12 has a partially spherical or curved surface (e.g., a spherical section) extending entirely about the skirt for engagement with an outer cap 14 (FIGS. 2-4) for a purpose detailed below. The inner cap skirt 12*b* has a plurality of vertical slits 12*e* extending from circumferential mid-line 12*f* (FIG. 8) to bottom edge 12*g* of the skirt to facilitate assembly of outer cap onto inner cap.

Figure 6:
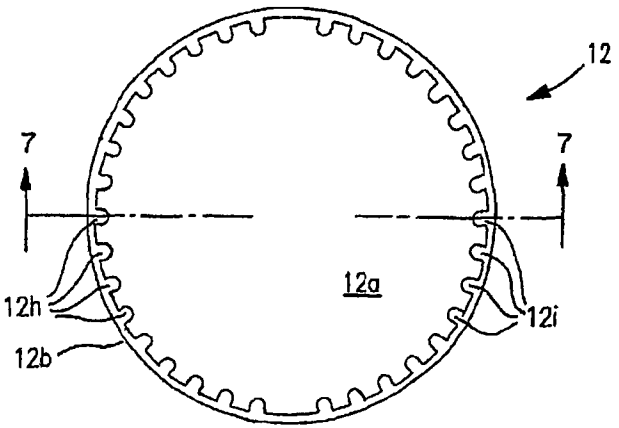
FIG. 6 is a top view of the inner cap of FIG. 2.
Figure 8:
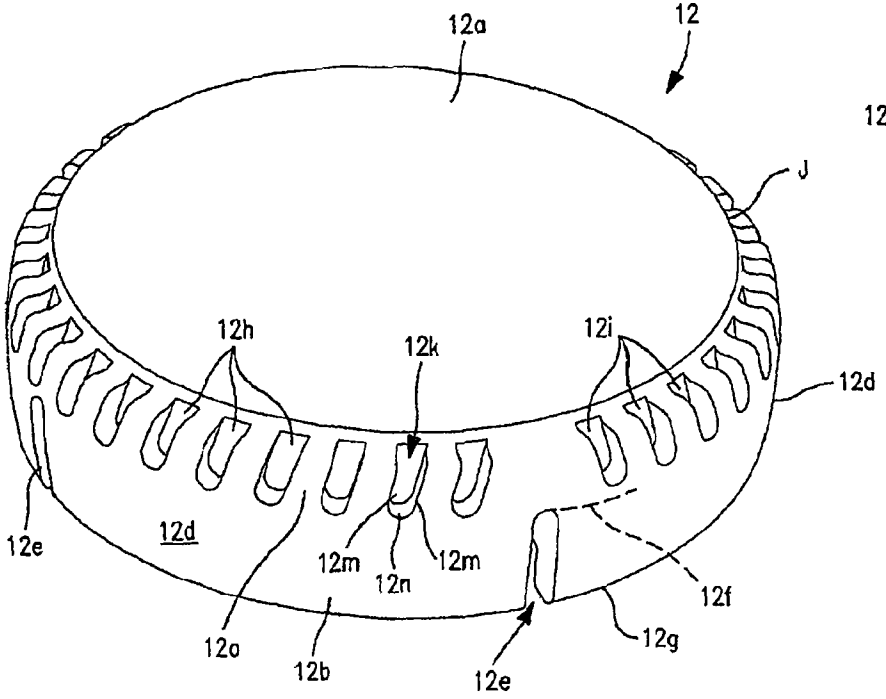
FIG. 8 is a perspective view of the topside of the inner cap of FIG. 2 showing drive notches.

The skirt outer surface at the juncture J with top panel 12*a* contains two sets of notches 12*h*, 12*i* (FIGS. 6-8) with each set occupying approximately one-half the perimeter of the skirt at the juncture of top panel, with one set of notches 12*h* being canted to the right, the other set 12*i* canted to the left. Each notch of both sets is defined by an access opening 12*k* through the top perimeter surface of skirt 12*b*, the opening 12*k* comprising parallel side walls 12*m*, and a curved bottom 12*n* joining the bottom edges of the side walls. The side walls 12*m* (and each notch) are off-set from vertical by an acute angle of between 2° and 30° and preferably at an angle of approximately 15°. Preferably, the notches are spaced from each other by skirt lands 12*o* having a width approximately equal to the notch width between parallel side walls. This arrangement provides the uniform appearance of the inner cap as best seen in FIG. 8. The right hand notches 12*i* are canted to the left, and the left hand notches 12*h* are canted to the right as seen in FIG. 8. The notches cooperate with drive teeth of the outer cap, as described below.

An outer cap 14 (FIGS. 3-5) according to the invention comprises top panel 14*a* and skirt 14*b* depending from the perimeter of the top panel 14*a*. The outer cap skirt has a partially spherical or curved inner surface 14*c* (e.g., a spherical section) of the same curvature as the outer surface 12*d* of the inner cap skirt. The outer cap is snapped in place over the inner cap with the inner cap skirt flexing inward between slits 12*e* (FIG. 8) to accommodate such assembly. By reason of the partially spherical or curved surface interface of outer cap skirt with inner cap skirt, the outer cap can tilt in every direction with respect to the inner cap. The degree of tilt is a function of cap diameter, and for typical consumer use in hand removal of the cap, the degree of tilt is in an approximate range of 1° to 10°, and preferably approximately 5° to 7°. See FIGS. 9and 10where the degree of tilt is indicated by angle a defined by the tilt of top panel 14*a* of the outer cap with respect to top panel 12*a* of the inner cap.

Figure 5:
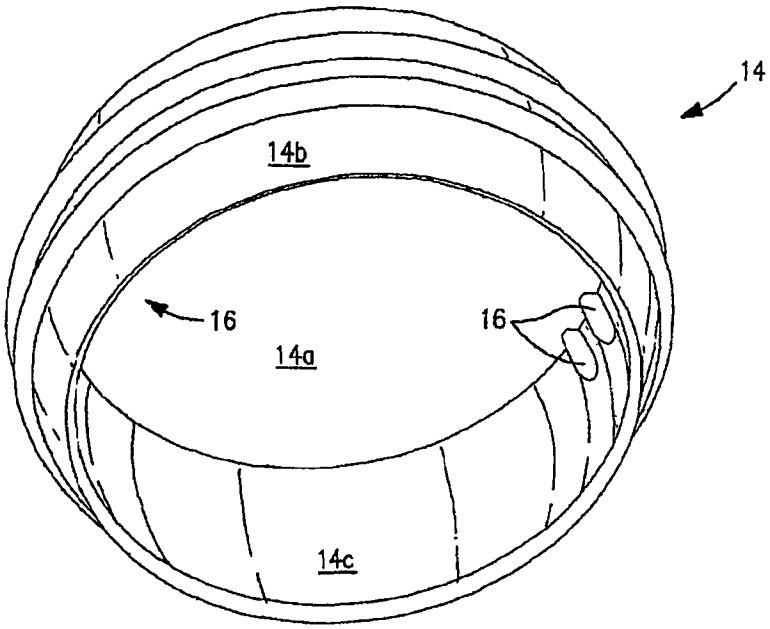
FIG. 5 is a perspective view of the underside of the outer cap of FIG. 2 showing drive teeth.

On the inside of the outer cap at the junction of top panel 14*a* and depending skirt 14*b*, the outer cap is fitted with a plurality of drive teeth 16 (seen best in FIG. 5) for insertion into the inner cap notches 12*h*, 12*i* for twisting the inner cap off the container neck. The teeth 16 depend from inside the outer cap as seen in FIGS. 2-5, 9, and 10. As shown in FIG. 5, the teeth 16 comprise a pair of ribs integral with underside of top panel 14*a* and the inner surface 14*c* of inner cap skirt. The base of each rib is joined to the underside of outer cap top panel, and a side of each rib is integral with outer cap skirt inner surface. The ribs are spaced apart a distance approximately equal to the spacing 12*o* between adjacent notches so that the ribs or teeth when in use cooperate with adjacent notches. It is preferred that the ribs be formed vertical in the outer cap so that a set of teeth is equally able to cooperate with both right and left hand notches. They may also be canted to the same degree as notches as described above.

The drive teeth are preferably set in pairs at diametrically opposed positions (FIG. 4) on the underside of the outer cap, and engage inner cap notches by tilting the outer cap with respect to the inner cap. A user selects direction of tilt by using either right hand or left hand according to natural ability, and twists outer cap either to right or to left in removing inner cap to open the container.

As shown in FIGS. 1 and 9 for right hand use, the outer cap tilts to the right to engage teeth and notches. The cap is removed to open the container by a twist in the direction of open arrow, and resealed by a twist in the opposite direction of close arrow. FIGS. 1 and 10 illustrate corresponding action for left handed use.

It is thus understood that the inner cap and the outer cap are assembled to each other at an interface defined by their partially spherical or curved surfaces and are thus capable of rotating freely with respect to each other. The outer cap is capable of being tilted with respect to the inner cap by movement of the outer cap with respect to the inner cap about the interface. By tilting the outer cap in a first direction, the outer cap engages the inner cap by means of engagement of teeth and notches for turning the inner cap on the container in a right hand direction. By tilting the outer cap in a second direction, the outer cap engages the inner cap, i.e., outer cap teeth engage inner cap notches, for turning the inner cap on the container in a left hand direction.

The child-proof position of the closure cap is shown in FIG. 2 with outer cap in level position with respect to inner cap, and particularly, with drive teeth disengaged from inner cap notches. Any effort to turn the outer cap results in the cap sliding on inner cap curved surface without turning the inner cap.

Another embodiment of the present invention comprises a closure cap 30, as shown in FIGS. 11-14. Similar to the closure cap 10, the closure cap 30 is suited for child proof applications and is designed for right and left hand removal of the cap from a container C. When the container C, and more specifically the neck of container C, receives and secures the closure cap 30, a seal is formed therebetween.

Figure 12A:
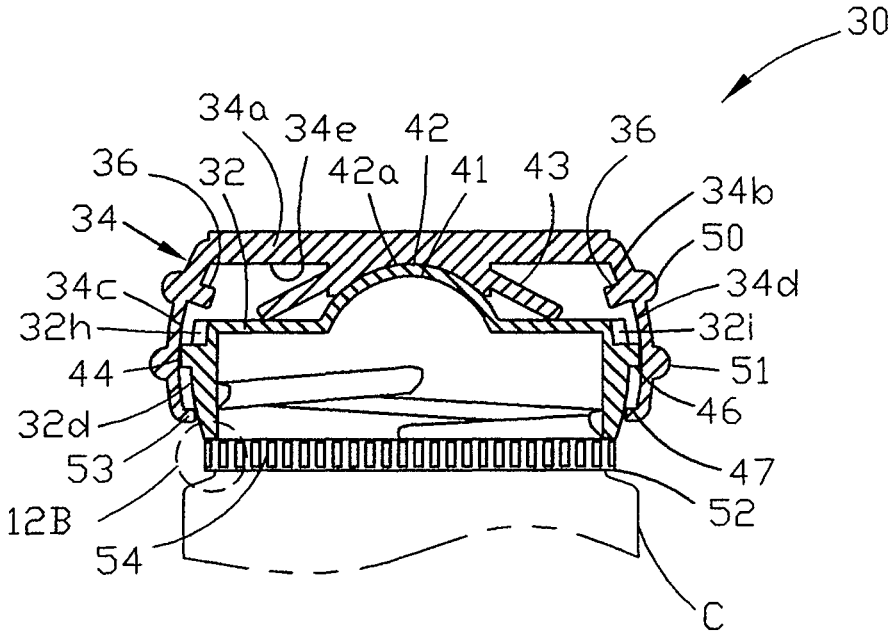
FIG. 12A is a side elevation section view of outer and inner caps of the closure cap of FIG. 11 in position on a container neck.
Figure 12B:
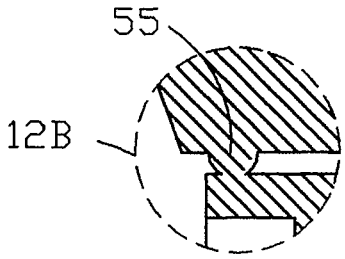
FIG. 12B is an enlarged view of a fastener frangibly attaching a tamper ring to the inner cap of the closure cap of FIG. 11.
Figure 13:
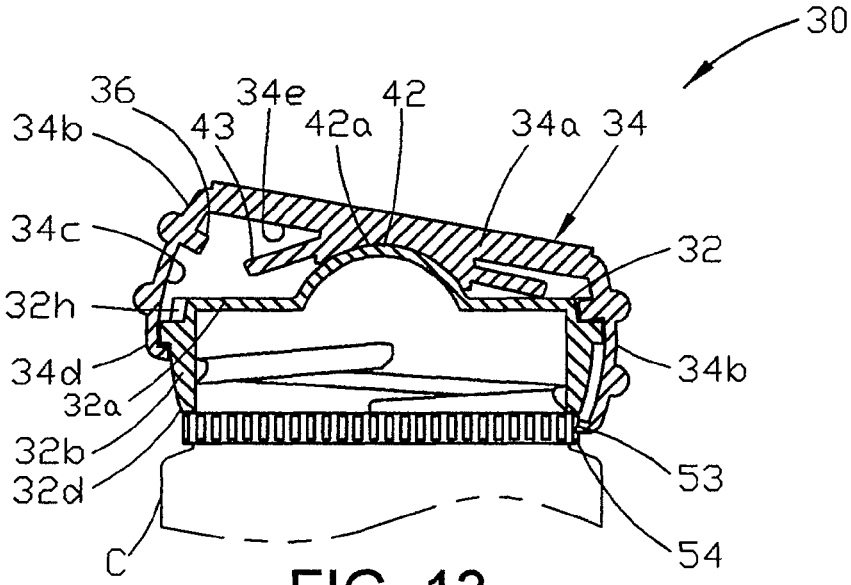
FIG. 13 is a side elevation section view of outer and inner caps of the closure cap of FIG. 11 tilted into position for right hand removal from a container neck.
Figure 14:
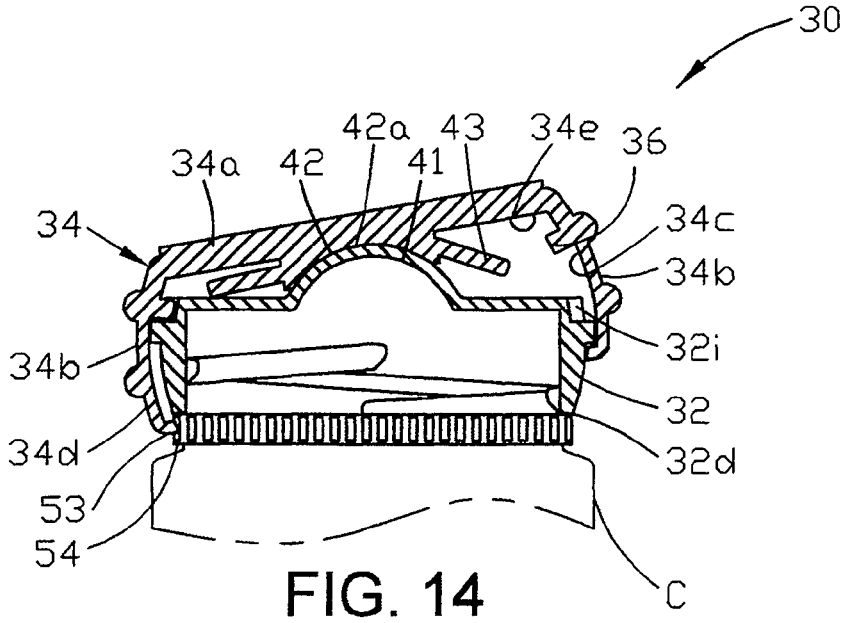
FIG. 14 is a side elevation section view of outer and inner caps of the closure cap of FIG. 11 tilted into position for left hand removal from a container neck.
Figure 15:
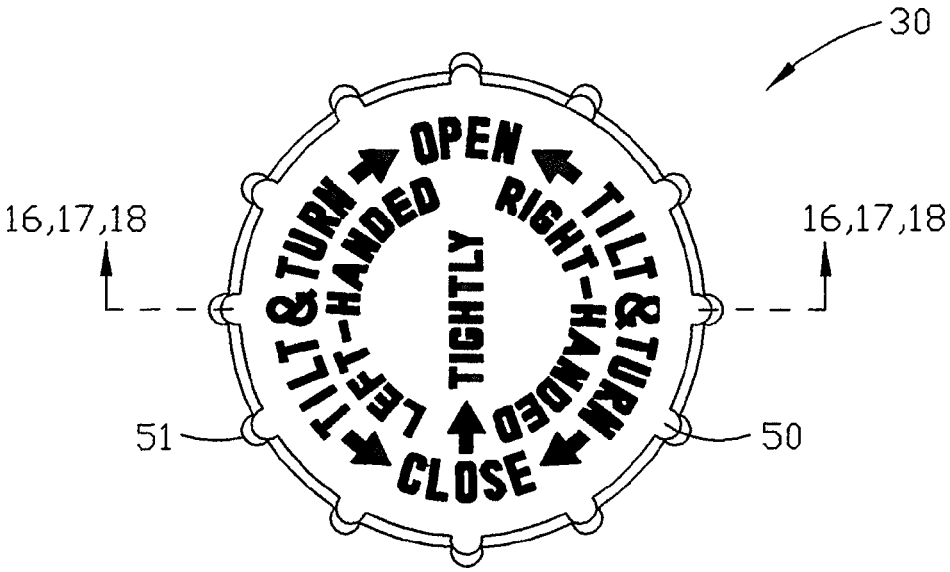
FIG. 15 is a top view of an embodiment of a closure cap according to the invention showing top panel legends for right and left hand turns to open and close cap on a container.

The closure cap 30 includes an inner cap 32 having a first top panel 32*a* and a depending first skirt 32*b*. The inner surface of the first skirt 32*b* has a helical bead for screwing the closure onto corresponding threads of the container neck. An outer surface 32*d* of the first skirt 32*b* has a partially spherical or curved surface (e.g., a spherical section) for engagement with an outer cap 34 (FIGS. 12-14). At the point where the first skirt outer surface 32*d* joins the first top panel 32*a*, two sets of notches 32*h*, 32*i* are disposed with each set occupying approximately one-half the perimeter of the first skirt 32*b*. The notches 32*h*, 32*i* have similar structural configurations as notches 12*h*, 12*i* respectively.

The closure cap 30 further includes an outer cap 34. The outer cap 34 has a second top panel 34*a* and a second skirt 34*b* depending from the perimeter of the second top panel 34*a*. The second skirt 34*b* has a partially spherical or curved inner surface 34*c* (e.g., a spherical section) of similar curvature as the outer surface 32*d* of the first skirt 32*b*. The outer cap 34 is connected to the inner cap 32 such that the inner surface 34*c* of second skirt 34*b* contacts the outer surface 32*d* of first skirt 32*b* in corresponding fashion (discussed in further detail below). As a result of the partially spherical or curved surface interface between the first and second skirts 32*b*, 34*b*, the outer cap 34 tilts in every direction with respect to the inner cap 32. The degree of tilt that is capable between the two caps can vary within a range of 1° to 10°, and preferably within a range of 5° to 7°.

Figure 19:
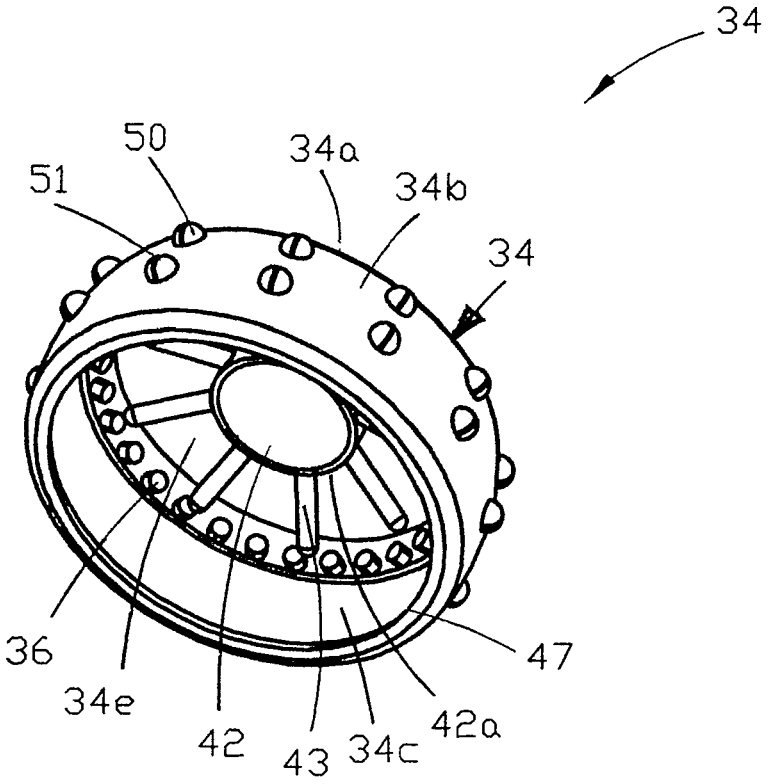
FIG. 19 is a perspective view of the outer cap of the closure cap of FIG. 15 having a plurality of drive teeth as well as spring.

With regard to the outer cap 34, a plurality of drive teeth 36 is fitted or mounted on the inner surface 34*c* of the second skirt 34*b*, proximate to second top panel 34*a* (seen best in FIG. 19). In some embodiments, the drive teeth 36 are distributed or spaced equally from each other around a circumference of the inner surface 34*c*. More specifically, the teeth 36 are spaced apart at a distance approximately equal to the spacing between adjacent notches 32*h* (or 32*i*) so that the teeth 36 cooperate with said notches when in use. Accordingly, the number of teeth 36 present on the second skirt 34*b* equals the number of notches 32*h*, 32*i* present in the first skirt 32*b*. The teeth 36 are adapted to be inserted into the notches 32*h*, 32*i* for twisting the inner cap 32 off the neck of container C. As shown in FIG. 19, the teeth 36 may be formed as small cylindrical projections integrated with the inner surface 34*c* of second skirt 34*b*. By tilting the outer cap 34 with respect to inner cap 32, the teeth 36 engage the notches 32*h*, 32*i*. Depending on the user's natural ability, he or she can select the direction of tilt using either the right hand or left hand and twist the outer cap 34—and subsequently the inner cap 32—either to the right or left in removing the inner cap 32 to open the container C.

Figure 11:
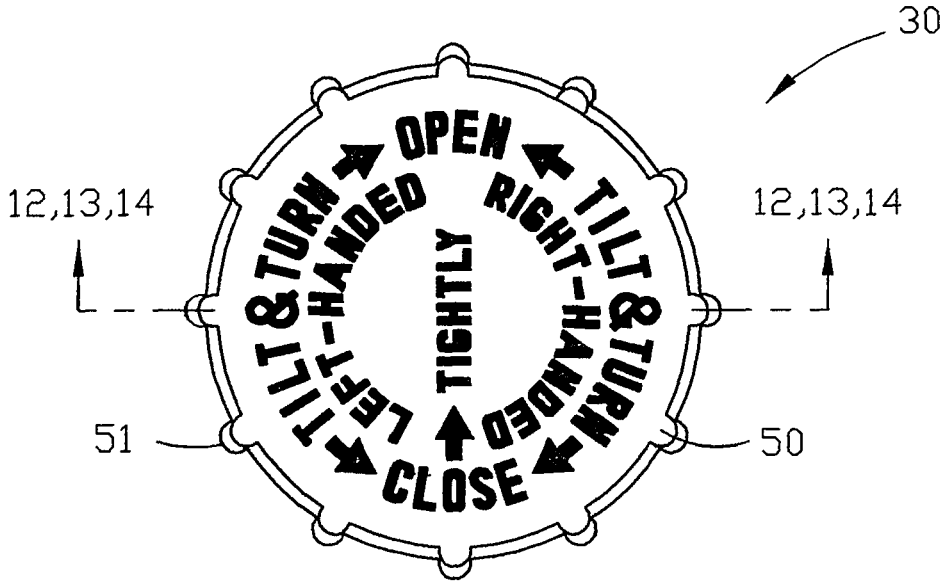
FIG. 11 is a top view of an embodiment of a closure cap according to the invention showing top panel legends for right and left hand turns to open and close cap on a container.

As shown in FIGS. 11 and 13 for right handed use, the outer cap 34 tilts to the right to engage teeth 36 and notches 32*i*. The closure cap 30 can then be removed to open the container by twisting the outer cap 34 (and inner cap 32) in the direction of the open arrow, and resealed by twisting in the direction of the close arrow. FIGS. 11 and 14 illustrate corresponding action for left handed use.

To facilitate in twisting the outer cap 34, a plurality of protrusions 50, 51 are disposed on an outer surface 34*d* of the second skirt 34*b*. In particular, the protrusions 50, 51 provide an uneven gripping surface, which enables the user to better grip or grasp the outer cap 34 with his or her fingers and thumb. In some embodiments, the protrusions are distributed evenly around the second skirt 34*b*. The outer cap 34 may be configured to have a single row of protrusions spaced along the circumference of the second skirt 34*b*. Alternatively, the outer cap 34 may have more than one row of protrusions. As shown in FIGS. 12-14 and 19, the outer cap 34 is configured with two rows of protrusions 50, 51. In some embodiments, the protrusions 50, 51 may have the shape of a hemisphere. However, other shapes may be used for the protrusions 50, 51. Moreover, instead of protrusions, the outer cap 34 may be adapted with grooves or indentations, preferably oriented vertically or near vertical, in the outer surface 34*d* of second skirt 34*b* to provide a gripping surface which facilitates the twisting of the outer cap 34 with either a left hand or right hand. It is also noted that the partially spherical or curved shape of the outer surface 34*d* of second skirt 34*b* provides an improved gripping surface for twisting the outer cap 34.

The closure cap 30 further comprises a spring 42 disposed on the underside 34*e* of the second top panel 34*a* of the outer cap 34. The spring 42 is adapted to spring load the outer cap 34 in a non-tilt arrangement relative to the inner cap 32. More specifically, when no tilting force is applied by the user on the outer cap 34, the spring 42 ensures that the first and second top panels 32*a*, 34*a* are substantially parallel with each other and do not form an angle therebetween. Similarly, after the user tilts and releases his or her grip over the outer cap 34, the spring 42 automatically repositions the outer cap 34 to a non-tilt arrangement.

The spring 42 may comprise a socket 42*a* which engages and contacts at least a central portion 41 of the first top panel 32*a* of the inner cap 32. The central portion 41 of the first top panel 32*a* may comprise a partially spherical surface, which extends upward towards the second top panel 34*a* of the outer cap 34. In some embodiments, the central portion 41 may comprise a hemisphere or semispherical shape, as shown in FIGS. 12-14. The socket 42*a* may comprise a concavely curved surface for receiving the central portion 41. More specifically, the socket 42*a* has a curvature which matches that of the surface of the central portion 41. With the central portion 41 in corresponding engagement and contact with the socket 42*a*, the socket provides support for the outer cap 34. More importantly, the socket 42*a* facilitates pivoting of the outer cap 34 relative to the inner cap 32 when the closure cap 30 is tilted. The socket 42*a* further maintains the alignment between the inner and outer caps 32, 34 so as to ensure proper pivoting.

In further embodiments, the spring 42 may comprise at least one spring arm 43 and preferably a plurality of spring arms 43. As shown in FIG. 19, the spring arms 43 are mounted proximate to a center of the underside 34*e* of the second top panel 34*a*. In other cases, the spring arms 43 may be mounted to the socket 42*a*. Regardless if the spring arms 43 are mounted proximate to the center of the underside 34*e* or directly to the socket 42*a*, the spring arms 43 extend radially therefrom towards the first top panel 32*a* proximate to a perimeter of the first top panel 32*a*. The length of each spring arm 43 is set so that the arm contacts the surface of the first top panel 32*a*. Accordingly, the contact between the spring arms 43 and the first top panel 32*a* of inner cap 32 helps to maintain the outer cap 34 in a non-tilt arrangement when no tilting force is applied thereto. When a user tilts the outer cap 34 to the right (FIG. 13), at least one of the spring arms 43 positioned substantially on the right side of the outer cap 34 is deflected and/or compressed. The deflection and/or compression of the spring arm 43 is translated into stored mechanical energy, which is subsequently used to restore the deflected spring arm 43 back to its original, pre-tilt state when the user stops tilting the outer cap 34. As a result, the deflected spring arm 43 positions the outer cap 34 back in the non-tilt arrangement (i.e., the first top panel 32*a* and the second top panel 34*a* being substantially parallel). In addition, the spring arms 43 that are diametrically opposite the deflected spring arm 43 prevent the deflected spring arm 43 from pivoting the outer cap 34 past the non-tilt arrangement. Accordingly, all the spring arms 43 work cooperatively to place the outer cap 34 in the non-tilt arrangement. FIG. 14 shows the situation where the user tilts the outer cap 34 to the left. Similarly, at least one of the spring arms 43 positioned substantially on the left side of the outer cap 34 is deflected and/or compressed. Once the user stops tilting the outer cap 34, the deflected spring arm 43 causes the outer cap 34 to return to the non-tilt arrangement. In preferred embodiments, each spring arm 43 is elastic to provide for the linear flex-spring characteristics.

In some embodiments, the outer cap 34 includes a flange 47, which is positioned at the free (or bottom) end of the second skirt 34*b* and extends along the circumference of the second skirt 34*b*. During construction of the cap 30, the inner cap 32 is forced into the outer cap 34 and is at least partially retained by means of the flange 47. The flange 47 projects inwardly from the inner surface 34*c* towards the vertical axis, or rotational axis, of the outer cap 34. In some embodiments, the flange 47 is substantially parallel to the second top panel 34*a*. When the outer cap 34 is in the non-tilt arrangement (FIG. 12) or in a tilted arrangement (FIGS. 13-14), the flange 47 is adapted to maintain contact with outer surface 32*d* of the first skirt 32*b*. The flange 47 serves as one way in which the outer cap 34 is in cooperative connection with the inner cap 32 (i.e., the inner surface 34*c* of second skirt 34*b* contacting the outer surface 32*d* of first skirt 32*b* in corresponding fashion). In some embodiments, the flange 47 comprises one single continuous piece extending along the circumference of the second skirt 34*b* and as such resembles a ring. In other embodiments, the flange 47 comprises teeth 53 that are spaced equally from each other along the circumference of the second skirt 34*b*.

The inner cap 32 may further comprise a lip 46 disposed on the outer surface 32*d* of the first skirt 32*b* of inner cap 32. Positioned below the notches 32*h*, 32*i*, the lip 46 wraps around the circumference of the first skirt 32*b*. The lip 46 is further adapted to maintain contact with the inner surface 34*c* of the second skirt 34*b* (FIGS. 12-14) as well as provide support for and facilitate proper tilting of the outer cap 34 (FIGS. 13-14). Accordingly, like the flange 47, the lip 46 serves as one way in which the outer cap 34 is in cooperative connection with the inner cap 32. In some embodiments, the lip 46 has a partially spherical or curved surface 44 of similar curvature as the inner surface 34*c* of the second skirt 34*b*.

The lip 46 also limits the degree in which the outer cap 34 can be tilted relative to the inner cap 32. When the outer cap 34 is tilted, a portion of the flange 47 engages the lip 46 and prevents the outer cap 34 from tilting any further. Accordingly, the engagement between the lip and flange defines a maximum degree of tilt for the outer cap. In some embodiments, the engagement between the lip and flange can be configured such that maximum degree of tilt equals the degree of tilt needed to be applied to the outer cap to remove the closure cap 30 (i.e., 1° to 10°). In other embodiments, the engagement between the lip and flange can be configured such that the maximum degree of tilt is set higher than the degree of tilt needed to remove the closure cap 30.

In FIG. 13, a left portion of the lip 46 is shown in engagement with a left portion of the flange 47. This engagement between the lip 46 and flange 47 limits the amount of left tilt that the outer cap 34 can experience. Likewise, as shown in FIG. 14, a right portion of the lip 46 is engaged with a right portion of the flange 47. This particular engagement between lip 46 and flange 47 limits the amount of right tilt that the outer cap 34 can experience. In addition to above function, the engagement between the lip 46 and flange 47 prevents the outer cap 34 from accidentally detaching from the inner cap 32 when the user simultaneously tilts and twists the outer cap.

In order to ensure container safety and security, the closure cap 30 may include a tamper ring 52. The tamper ring 52 indicates and serves as proof of whether the closure cap 30 has been opened and/or the container barrier has been broken. The tamper ring 52 is secured around the container C and attached to the free (or bottom) end of the first skirt 32*b* of the inner cap 32 by at least one fastener 55 (FIG. 12A). In some embodiments, several fasteners 55 distributed equally along the end of the first skirt 32*b* may be used. The fastener 55 is further characterized as being frangible and thus adapted to break upon tilting and twisting the outer cap 34 (discussed in further detail below). However, before the fastener 55 is broken, the tamper ring 52 provides protection against inadvertent separation of the closure cap 30 from the neck of the container C. As shown in FIG. 12, the fastener 55 may have a spherical profile.

To break the fastener and enable the closure cap 30 to be removed from the container C, the outer cap 34 is tilted and twisted simultaneously. More specifically, a portion of the flange 47 engages the tamper ring 52 when the outer cap 34 is tilted (FIG. 13-14). This engagement between the flange 47 and the tamper ring 52 provides the necessary mechanics to break the fastener 55 and release the tamper ring 52 from the first skirt 32*b* when the outer cap 34 is twisted. The tamper ring 52 may further be adapted with grooves 54 spaced along the entire circumference of the tamper ring 52 to facilitate the engagement between the flange 47 and the tamper ring 52. This particular configuration of the tamper ring 52 involves the teeth 53 of flange 47 being inserted into slots formed between each of the grooves 54. The resulting stable connection created by the interconnections of the teeth and grooves is sufficient to break the fastener 55 upon twisting the outer cap 34.

Figure 16:
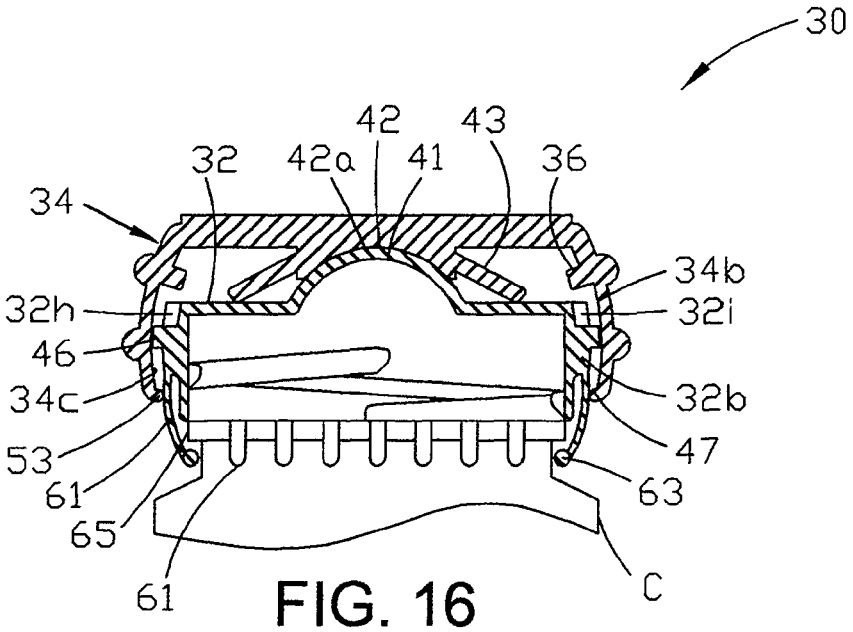
FIG. 16 is a side elevation section view of outer and inner caps of the closure cap of FIG. 15 in position on a container neck.

Another embodiment of the present invention is shown in FIGS. 15-18. The closure cap 30 in these figures has many of the same characteristics and features as the closure cap illustrated in FIGS. 11-14. However, the closure cap 30 does not comprise a tamper ring secured around the container C. Instead, the closure cap 30 has a different mechanism for tamper-proofing and locking the closure cap 30 to the container C and thus preventing separation unless the outer cap 34 is simultaneously tilted and twisted. Specifically, the inner skirt 32*b* of the inner cap 32 has a plurality of curved fingers 61 that are attached circumferentially around the outer surface 32*d* of the skirt. As shown in FIG. 16, each finger 61 is attached at a circumferential mid-line of the first skirt 32*b* below the lip 46. The length of the fingers 61 is set such that each finger extends downward beyond the free end of the first skirt 32*b* and engages the neck of the container C as well as a protrusion or flange 65 on the neck. In some embodiments, the end of each finger 61 has an enlarged tip 63 for further establishing the engagement between the fingers 61, neck of container C, and protrusion 65. The tips 63 can comprise various shapes, such as a substantially spherical profile.

Figure 17:
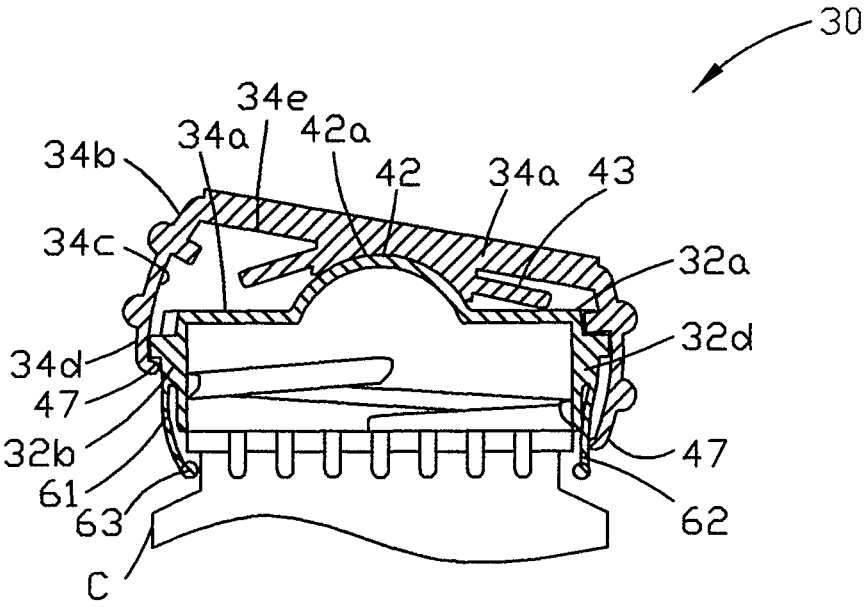
FIG. 17 is a side elevation section view of outer and inner caps of the closure cap of FIG. 15 tilted into position for right hand removal from a container neck.
Figure 18:
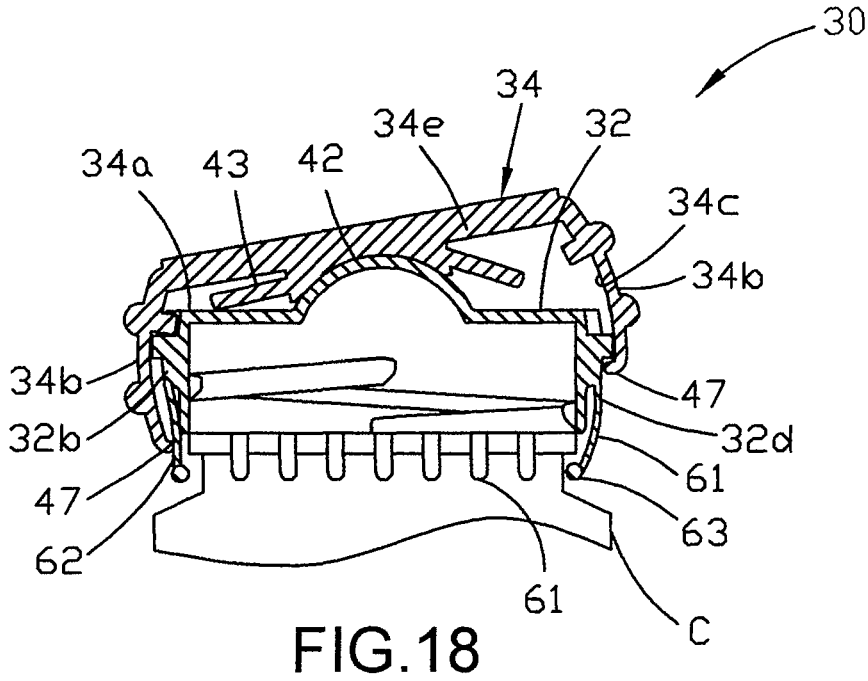
FIG. 18 is a side elevation section view of outer and inner caps of the closure cap of FIG. 15 tilted into position for left hand removal from a container neck.

In order to remove the closure cap 30 from the container C, at least one of the fingers 61 must be disengaged from the protrusion 65 and the neck of the container C. As shown in FIGS. 17-18, to disengage the fingers 61, the user merely has to perform the same process of tilting and twisting the outer cap 34. When the outer cap 34 is tilted, a portion of the flange 47 deflects and creates a bending moment on the at least one of the fingers 61 (shown as 62 in FIGS. 17-18), such that the finger 61 and its enlarged tip 63 are free from interference with the protrusion 65. Further, as the outer cap 34 is continuously rotated with the simultaneous helical movement (due to the threads on the container neck) additional fingers 61 are deflected and disengaged from the protrusion 65 and neck. As a result, the closure cap 30 is unlocked and can be removed from the container C. Conversely, when the closure cap 30 is placed back on the neck of the container C, the fingers 61 re-engage with the protrusion 65 and neck of the container. Closure cap 30, thereafter, is locked onto the container C. In some embodiments, the curved fingers 61 are made flexible and elastic.

It is noted that the additional features of the spring 42, tamper ring 52, and the locking mechanism created by fingers 61 and protrusion 65 do not increase the necessary level of hand and finger strength or cognitive ability to remove the closure cap 30 from the container C. Closure caps which incorporate the spring 42, tamper ring 52, and/or fingers 61 require the same tilting and twisting action that is needed to remove a closure cap configured without these components.

In view of the above, it is to be understood then, a child proof right and left hand operable closure cap according to the invention comprises two operating components readily fabricated using commonly available plastic or equivalent material in well known manufacturing processes including plastics molding and metal stamping.

The term approximately for purposes of this application means plus or minus 10% of the values stated.

Various changes may be made to the structure embodying the principles of the invention. The foregoing embodiments are set forth in an illustrative and not in a limiting sense. The scope of the invention is defined by the claims appended hereto.

What is claimed is:

1. A child-proof closure cap for a container, comprising:

an inner cap comprising:

a first top panel having a central portion and a substantially planar annular surface surrounding the central portion and extending outward from the central portion to an outer edge; and, a first skirt extending downward from the first top panel, the first skirt having:

an outer surface;

a plurality of notches with upwardly directed openings surrounding the outer edge of the first top panel; and, a first inner surface with threads for engaging corresponding threads on the container; and an outer cap mounted over the inner cap, the outer cap being tiltable and rotatable with respect to the inner cap, the outer cap comprising:

a second top panel;

a second skirt extending downward from the second top panel, the second skirt having:

a second inner surface in engagement with the outer surface of the first skirt; and, a plurality of teeth projecting inward from the second inner surface;

a spring disposed on an underside of the second top panel, the spring being adapted to spring load the outer cap in a non-tilt arrangement relative to the inner cap, the spring in slidable contact with the annular surface of the first top panel;

wherein, when the outer cap is titled with respect to the inner cap, at least a portion of the teeth on the second inner surface of the second skirt engage within at least a portion of the upwardly directed openings for releasably turning the inner cap to open the container.

2. The child-proof closure cap according to claim 1, wherein the central portion of the first top panel of the inner cap further comprises a raised hemispherical surface; and, wherein the spring of the outer cap further comprises a socket engaging with the raised hemispherical surface to effectively support the outer cap.

3. The child-proof closure cap according to claim 2, wherein the raised hemispherical surface of the central portion of the first top panel is convex and the socket has a concavely curved surface receiving the raised hemispherical surface; and the concavely curved surface facilitates pivoting of the outer cap relative to the inner cap when the outer cap is tilted.

4. The child-proof closure cap according to claim 1, wherein said spring comprises a plurality of spring arms mounted proximate to a center of the underside of the second top panel, said spring arms extending radially outward from the underside towards the first top panel, said spring arms being adapted for deflection by the annular surface of the first top panel when the outer cap is tilted.

5. The child-proof closure cap according to claim 4, wherein the spring arms contact the first top panel proximate to the outer edge.

6. The child-proof closure cap according to claim 4, wherein the spring arms are elastic.

7. The child-proof closure cap according to claim 1, further comprising a flange disposed at an end of the second skirt along a circumference of the second skirt, said flange projecting inward from the second inner surface of the second skirt, wherein the flange contacts the outer surface of the first skirt.

8. The child-proof closure cap according to claim 7, wherein the outer surface of the first skirt has a circumferential lip positioned under the notches; and wherein a portion of the flange is adapted to engage the circumferential lip when the outer cap is tilted, the engagement between the portion of the flange and the circumferential lip limiting a degree of tilt.

9. The child-proof closure cap according to claim 7, further comprising a tamper ring frangibly attached to an end of the first skirt by at least one fastener, said tamper ring adapted to be secured around an opening of the container to indicate tampering of the container.

10. The child-proof closure cap according to claim 9, wherein a portion of the flange is adapted to engage the tamper ring when the outer cap is tilted, the engagement between the portion and the tamper ring being adapted to release the tamper ring from the first skirt.

11. The child-proof closure cap according to claim 1, wherein each of the upwardly directed openings of the inner cap is formed in the outer surface of the first skirt and displaced below the first top panel so as to be spaced from the outer edge of the first top panel.

12. The child-proof closure cap according to claim 1, wherein, when no tilting force is applied to the outer cap, the first top panel is substantially parallel to the second top panel, the outer cap rotates about the inner cap without engagement between the teeth and the notches.

13. The child-proof closure cap according to claim 1, further comprising a plurality of protrusions disposed on an outer surface of the second skirt, said protrusions being adapted to provide a grip of the outer cap.

14. A child-proof closure cap for covering and sealing a container having an open neck with exterior threads, the child-proof closure cap comprising:

an inner cap comprising:

a first top panel; and, a first skirt extending downward from a peripheral edge of the first top panel, the first skirt having:

an annular series of notches formed within an outer surface surrounding the first top panel and spaced from the peripheral edge; and, a first inner surface with interior threads for screwing the inner cap onto the corresponding exterior threads on the open neck of the container;

an outer cap covering the inner cap and being tiltable and rotatable with respect to the inner cap, the outer cap comprising:

a second top panel; and, a second skirt extending downward from the second top panel, the second skirt having:

an annular series of teeth projecting radially inward from a second inner surface and proximate to the second top panel; and, a circumferential flange disposed at a distal edge and projecting inward from the second inner surface, wherein the circumferential flange engages the outer surface of the first skirt;

an annular peripheral edge separating the annular series of teeth of the second skirt from the second top panel; and, wherein, when the outer cap is tilted with respect to the inner cap, the annular series of teeth at least partially engage the annular series of notches on the outer surface of the first skirt for turning the inner cap in a direction to release the inner cap from the container.

15. The child-proof closure cap according to claim 14, wherein the closure cap further comprises a plurality of fingers disposed around a circumference of the closure cap and extending substantially downward, the fingers being adapted to engage a protrusion on the container.

16. The child-proof closure cap according to claim 15, wherein the outer surface of the first skirt has a lip positioned under the annular series of notches and extending around the first skirt;

wherein, when the outer cap is tilted, a first portion of the flange is adapted to engage the lip and at least one of said fingers is deflected, the engagement between the first portion and the lip limiting a degree of tilt, and the deflection disengaging at least one finger of said fingers from the protrusion on the container.

17. The child-proof closure cap according to claim 16, wherein said fingers are elastic.

18. The child-proof closure cap according to claim 14, wherein the outer cap has a spring disposed on an underside of the second top panel, the spring being adapted to spring load the outer cap in a non-tilt arrangement relative to the inner cap.

19. A child-proof closure cap for a container, comprising:

an inner cap comprising:

a first top panel having a central portion and a substantially planar annular surface surrounding the central portion and extending outward from the central portion to an outer edge of the first top panel;

a first skirt extending downward from the first top panel, the first skirt having an outer surface and a plurality of notches with upwardly directed openings around a circumference of the outer surface, wherein a first inner surface of the first skirt includes threads for engaging corresponding threads on the container; and an outer cap fitted over the inner cap, the outer cap being tiltable and rotatable with respect to the inner cap, the outer cap comprising:

a second top panel;

a second skirt extending downward from the second top panel, the second skirt having a second inner surface and a plurality of teeth disposed proximate to the second top panel and projecting inward from the second inner surface;

a spring disposed on an underside of the second top panel, the spring having:

a socket engaging at least the central portion of the first top panel; and, plurality of spring arms mounted to the socket extending radially from a center of the underside towards the first top panel and contacting the annular surface of said first top panel, wherein the spring is adapted to spring load the outer cap in a non-tilt arrangement relative to the inner cap;

wherein, when the outer cap is tilted with respect to the inner cap, at least a portion of the teeth on the second inner surface of the second skirt engage within at least a portion of the notches on the outer surface of the first skirt via the upwardly directed openings of the at least a portion of the notches for turning the inner cap in a direction to release the inner cap from the container.

20. The child-proof closure cap according to claim 19, further comprising:

a flange disposed at an end of the second skirt along a circumference of the second skirt, said flange projecting inward from the second inner surface of the second skirt, wherein the flange contacts the outer surface of the first skirt;

wherein said outer surface of the first skirt has a lip positioned under the notches and extending around the first skirt, and a portion of the flange is adapted to engage the lip when the outer cap is tilted, the engagement between the portion of the flange and the lip limiting a degree of tilt.

* * * * *